US006998766B2

(12) United States Patent
Ryu

(10) Patent No.: US 6,998,766 B2
(45) Date of Patent: Feb. 14, 2006

(54) ELEMENT FOR A COLOR FLAT PANEL DISPLAY

(75) Inventor: Sang-Chul Ryu, Kumi (KR)

(73) Assignee: LG Philips Displays Korea Co., LTD, Kyeongsangbuk-Do (KR)

( * ) Notice: Subject to any disclaimer, the term of this patent is extended or adjusted under 35 U.S.C. 154(b) by 33 days.

(21) Appl. No.: 10/447,151

(22) Filed: May 29, 2003

(65) Prior Publication Data

US 2003/0222567 A1 Dec. 4, 2003

(30) Foreign Application Priority Data

May 29, 2002 (KR) ..... 2002-29972

(51) Int. Cl.
*H01J 29/10* (2006.01)

(52) U.S. Cl. ..... 313/461; 313/466; 313/473

(58) Field of Classification Search ..... 313/461, 313/466, 473
See application file for complete search history.

(56) References Cited

U.S. PATENT DOCUMENTS 4,717,856 A * 1/1988 Kato ..... 313/466

FOREIGN PATENT DOCUMENTS

| | | |
|---|---|---|
| JP | 3-184247 A | 8/1991 |
| JP | 3-205751 A | 9/1991 |
| JP | 5-314932 A | 11/1993 |
| JP | 6-231701 A | 8/1994 |
| JP | 7-141998 A | 6/1995 |

* cited by examiner

*Primary Examiner*—Vip Patel
(74) *Attorney, Agent, or Firm*—Birch, Stewart, Kolasch & Birch, LLP

(57) ABSTRACT

A screen composite provided on a face plate of a flat panel display device, said screen composite containing an aluminum layer and a metal layer formed on said aluminum layer for substantially reducing a halation phenomenon.

5 Claims, 4 Drawing Sheets

ELEMENT FOR A COLOR FLAT PANEL DISPLAY

BACKGROUND OF THE INVENTION

This application claims the benefit of the Korean Application No. 2002-0029972 filed on May 29, 2002, which is hereby incorporated by reference.

1. Field of the Invention

The present invention relates to a color flat panel display, and more particularly, to an element for a color flat panel display which provides good image quality with a high contrast property by forming a reflecting layer on the display device, which is applied to the inner surface of a face plate, using a new metal material to remove halation caused by the reentry of scattered electrons from the rear surface of the fluorescent layer in the case of a display device using an electron beam.

2. Description of the Background Art

Generally, a cathode-ray tube (Brown tube) is mainly used as an image display device for color television. However, the cathode-ray tube has a very deep depth compared to the size of the front surface of the screen, caused by the structural characteristic of the cathode-ray tube. Therefore, it is impossible to fabricate a television picture receiver of the thin type.

Thus, apparatus using display devices such as an EL display element, a plasma display element, and a liquid crystal display element are developing as a flat panel display devices of the thin type. However, these devices have some problems, such as brightness, contrast, and color reproductibility when compared to the cathode-ray tube.

Japan Patent 3-184247 and Japan Patent 3-205751 disclose image display devices which construct a screen on a color television by dividing the picture on the screen into sections of a matrix and by deflecting irradiating electron beams toward respective sections to emit the fluorescent, with the object of displaying an image of high quality, similar to that of a cathode-ray tube, on a flat panel using an electron beam.

Hereinafter, an example of the conventional image display device described above will be described with reference to the accompanying Figures.

FIG. 1 is a view showing the structure of a conventional image display device.

As shown in FIG. 1, the image display device comprises: a glass container 1 defining a rear wall; a back electrode 2 of the plane plate type located at the front side of the glass container 1; a plurality of cathode filaments 3 of linear shape arranged at the front side of the back electrode 2 for discharging electrons; a control electrode 4, on which a plurality of penetrating holes are formed with a predetermined intervals therebetween, located at the front side of the cathode filaments 3; a plurality of signal modulation electrodes 5 arranged as bands and located at the front side of the control electrode 4 for controlling the electrons which passed through the penetrating holes in the control electrode 4; a focusing electrode 6 having a plane plate shape, and in which a plurality of slots are formed at predetermined intervals and located at the front side of the signal modulation electrode 5; a horizontal deflection electrode 7 formed by overlapping two plane plates of comb shape in the vertical direction and located at the front side of the focusing electrode 6; a vertical deflection electrode 8 formed by overlapping two plane plates of comb shape in horizontal direction and located at the front side of the horizontal deflection electrode 7; and a face plate 9 located at the front side of the vertical deflection electrode 8, including all components thereof, and maintaining the vacuum status therein by suitable coupling with the glass container 1.

The cathode filaments 3 are installed in the horizontal direction for generating electron beams distributed evenly in the horizontal direction, and a plurality of cathode filaments (4 filaments herein) are installed in the vertical direction while maintaining appropriate intervals therebetween. The cathode filaments 3 are made by applying an oxide cathode material on tungsten lines.

The back electrode 2 is made of a conductive material of plane plate shape, installed parallel with the cathode filaments 3.

The control electrode 4 is located at the front side of the cathode filaments 3 in the direction of the screen, faces the back electrode 2, and is made of a conductive plate in which rows of penetrating holes 4*a*, installed in a horizontal direction with appropriate intervals therebetween, are formed to be located on horizontal lines facing respective cathode filaments 3.

The signal modulation electrode 5 is made of a plurality of conductive plate rows which are thin and long in the vertical direction and arranged in positions facing the penetrating holes 4*a* of the control electrode 4, with predetermined intervals therebetween. The respective conductive plates include a plurality of penetrating holes 5*a* having the same shape as the penetrating holes 4*a* of the control electrode 4 at positions facing the penetrating holes 4*a*.

The focusing electrode 6 includes penetrating holes 6*a* at positions facing the respective penetrating holes 5*a* of the signal modulation electrode 5.

The horizontal deflection electrode 7 consists of two conductive plates of comb shapes which are engaged with each other in the vertical direction with a predetermined interval on the same plane.

The vertical deflection electrode 8 consists of two conductive plates of comb shapes which are engaged with each other in a horizontal direction with a predetermined interval on a same plane.

The fluorescent layer emitting light by irradiation of an electron beam is applied to the inner surface of the face plate 9 to form a screen 20.

In addition, as shown in FIG. 3, the screen 20 is formed by applying a graphite layer 21 and a fluorescent layer 22 on an upper part of the face plate 9, and by applying an aluminum layer 23 on the upper parts of the graphite layer 21 and the fluorescent layer 22.

The control electrode 4, the signal modulation electrode 5, the focusing electrode 6, the horizontal deflection electrode 7, and the vertical deflection electrode 8 are attached by using insulating adhesives (not shown). The above components are arranged inside the image display device with constant intervals therebetween.

The operations of the above image display device will be described as follows.

Referring to FIG. 1, the cathode filaments 3 are heated by flowing electrical current in order to discharge the electrons easily. The electron beam of sheet-phase is discharged from the surface of the cathode filament 3 by applying appropriate voltages to the back electrode 2, to the cathode filaments 3, and to the control electrode 4 whereby the cathode filaments 3 are heated.

The electron beam of sheet-phase is divided into a plurality of bundles by the penetrating holes 4*a* of the control electrode 4 to form the plurality of electron beam bundles 11 (an electron beam bundle is represented in FIG. 1).

The amount of passage of the electron beam bundle 11 is controlled independently by the signal modulation electrode 5 corresponding to the image signal applied to the signal modulation electrode 5.

Next, the electron beam 5, which passes through the signal modulation electrode 5, is focused and shaped by the electrostatic lens effect of the penetrating holes 6*a* on the focusing electrode 6, and then deflected horizontally and vertically by the potential difference of the adjacent conductive plates of the horizontal deflection electrode 7 and the adjacent conductive plates of the vertical deflection electrode 8.

In addition, a high voltage, e.g., 10 kV, is applied to the graphite layer 21 of the screen 20, and therefore, the electron beam is accelerated with high energy and crashes with the graphite layer 21 to radiate the fluorescent layer formed on the inner surface of the face plate.

In more detail, when the television screen is divided as a matrix and the screen is set to be an aggregate of 10 divisions, the respective divided electron beam corresponds to respective 10 divisions. Therefore, the entire image to be presented is projected onto the screen 20 by causing the divided electron beam to correspond to respective 10 divisions to deflect and irradiate the electron beam only to the particular respective division.

Also, image signals of red, green, and blue colors corresponding to respective images are controlled by the signal modulation electrode 5 to reproduce the television moving pictures.

However, in the conventional image display device of the flat panel type, in the case where the electron beam is irradiated to both poles of the display device, some portion around the position where the electron beam is irradiated, glimmers, that is, generates the halation phenomenon.

The halation phenomenon is generated because the electron beam collides with the fluorescent layer of the screen 20 causing a portion of the electron beam to reenter into the fluorescent layer.

Especially, in the case where the voltages at both poles are high, the phenomenon can be prominently seen. Therefore, the contrast of the display device is reduced, a clear image cannot be obtained, and the functions of the display can become a big problem.

In order to solve the above problem, Japanese Patent Publications 5-314392, 6-231701, and 7-141998 have been suggested.

In Japanese Patent Publication 5-314932, the electron beam re-entry is restrained to be less than 30% by forming an aluminum layer on the fluorescent layer and controlling the thickness of the aluminum layer. In addition, it discloses that the thickness of the aluminum layer should be 2000 Å~3500 Å in case that the voltage of aluminum layer on the face plate is 10 kV; 1500 Å~3000 Å in the case where the voltage is 9 kV, and 1500 Å~2000 Å in the case where the voltage is 8 kV.

In Japanese Patent Publication 6-231701, the fluorescent layer, the aluminum layer, and the carbon layer or boron containing layer are laminated on inner surface of a glass face, and fine embossing is formed on the surface of the aluminum layer facing the fluorescent layer. The carbon layer or the boron containing layer should be thicker than the aluminum layer; a gas discharge hole is formed in the carbon layer, and a gas discharge hole is formed as corresponding to the graphite in the black matrix.

Also, the carbon layer is made by laminating graphite particles having diameters of less than 1 $\mu$m to be a thickness of less than 1 $\mu$m. In addition, the boron layer instead of the carbon layer is formed by evaporating or sputtering.

In addition, the aluminum layer among the laminated layers is formed on the fluorescent layer using a transcription method which forms the layer on a predetermined film in advance.

In Japanese Patent Publication 7-141998, the ratio between the thickness and diameter of the carbon layer laminated on the aluminum layer is constructed to be 1:10 or more, and formed by laminating graphite granules having a sphere volume conversion average particle diameter of less than 2 $\mu$m.

In addition, the carbon layer is formed laminating the graphite granules in an amount of 20 $\mu g/cm^2$~220 $\mu g/cm^2$ per unit area.

A representative embodiment of the above patents is shown in FIG. 3.

However, the above patents are not capable of effectively solving the halation problem.

SUMMARY OF THE INVENTION

Accordingly, an object of the present invention is to provide a color flat panel display which substantially eliminates halation problems caused by the reentry of scattered electrons from the fluorescent layer of a display device involving the use of the electron beam, and which has a high degree of contrast by using a forming material such as iron or nickel instead of the conventional carbon or boron on a fluorescent layer laminated on a glass face plate.

To achieve the object of the present invention, as embodied and broadly described herein, there is provided a device for a color flat panel display, as a device for radiating the fluorescent layer by the collision of the electron beam, by providing at least one or more layers among iron, nickel, chrome on an aluminum layer, in a screen which includes a face plate of glass material, a graphite layer formed on the upper part of the face plate, a fluorescent layer formed on upper part of the graphite layer, a resin film layer formed on upper part of the fluorescent layer, and an aluminum layer formed on the resin film layer.

The foregoing and other objects, features, aspects and advantages of the present invention will become more apparent from the following detailed description of the present invention when taken in conjunction with the accompanying drawings.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

Reference will now be made in detail to the preferred embodiments of the present invention, examples of which are illustrated in the accompanying drawings.

Figure 1:
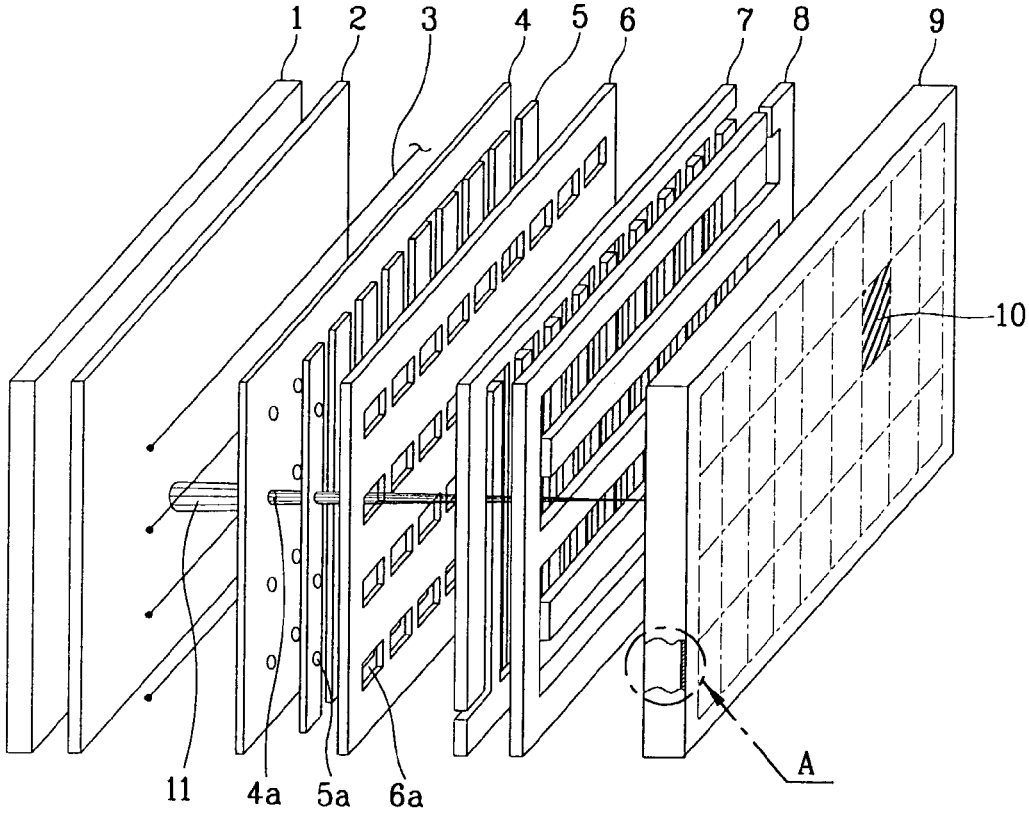
FIG. 1 CONVENTIONAL ART
FIG. 1 is a perspective view showing the structure of a general color flat panel display device.
Figure 2:
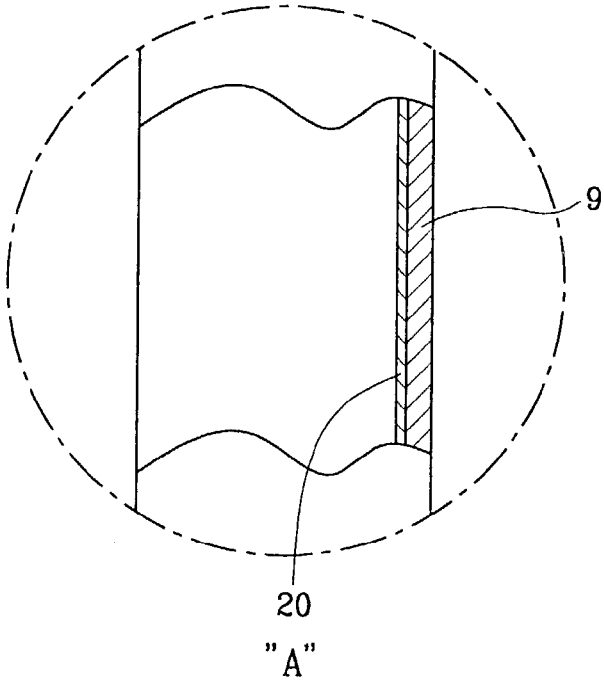
FIG. 2 CONVENTIONAL ART
FIG. 2 shows an exploded section A of a portion of the flat panel display device of FIG. 1.
Figure 3:
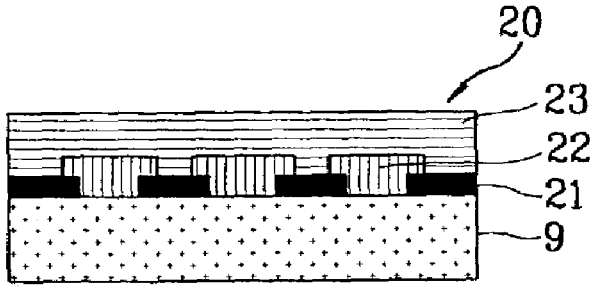
FIG. 3 CONVENTIONAL ART
FIG. 3 is a cross-sectional view showing the cross section of a display element included in a conventional color flat panel display.

The present invention relates to a screen 20 applied to the inner side surface of the face plate 9, among the components shown in FIG. 1.

Embodiments for a screen 200, that is, a color flat panel display element according to the present invention will now be described.

Figure 4:
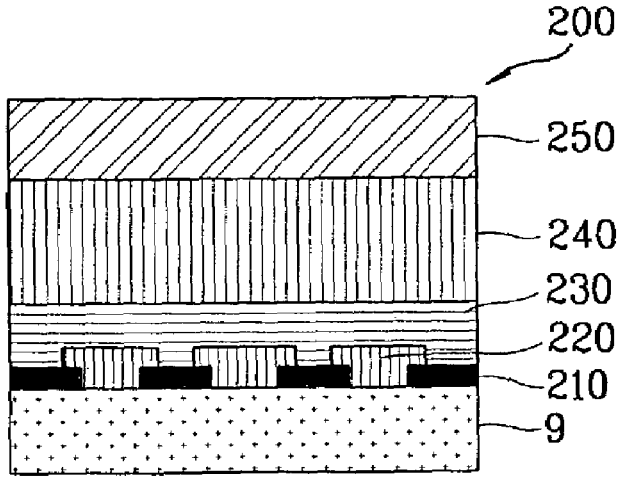
FIG. 4 is a cross-sectional view showing a first embodiment of a color flat display element according to the present invention.

As shown in FIG. 4, the screen of a first embodiment according to the present invention comprises: a graphite layer 210 and a fluorescent layer 220 on a face plate 9 of glass material; a resin film layer 230 applied to the fluorescent layer 220; an aluminum layer 240 applied on the resin layer 230; and an iron 250 applied to the aluminum layer 240.

Figure 5:
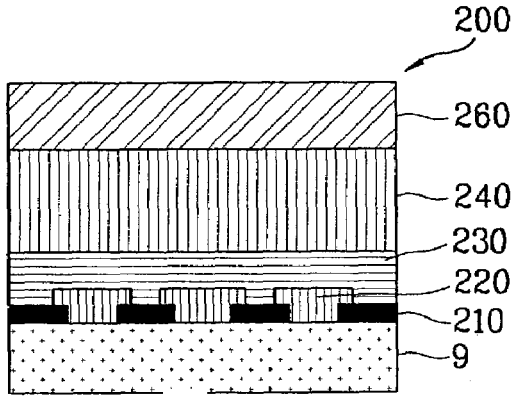
FIG. 5 is a cross-sectional view showing a second embodiment of the color flat display element according to the present invention.

As shown in FIG. 5, the screen of a second embodiment according to the present invention comprises: a graphite layer 210 and a fluorescent layer 220 on a face plate 9 of glass material; a resin film layer 230 applied to the fluorescent layer 220; an aluminum layer 240 applied to the resin layer 230; and a nickel 260 applied to the aluminum layer 240.

The iron layer 250 and the nickel layer 260 can be replaced with a chromium layer.

Hereinafter, embodiments of the method for fabricating the screen 200, that is, the color flat panel display element, will be described in detail.

As a first embodiment of the method for fabricating the screen 200, the screen 200 shown in FIG. 4 and FIG. 5 is formed by laminating the fluorescent layer 220 on the graphite layer 210 which is laminated on the face plate 9. The resin film layer 230 is laminated on the fluorescent layer 220 and the aluminum layer 240 is formed on the resin film layers 230 using an evaporating method or a sputtering method. In addition, the iron 250 or the nickel 260, that is, the material used for restraining secondary radiation of electrons is formed on the aluminum layer 240 by the evaporating method or the sputtering method.

Figure 6:
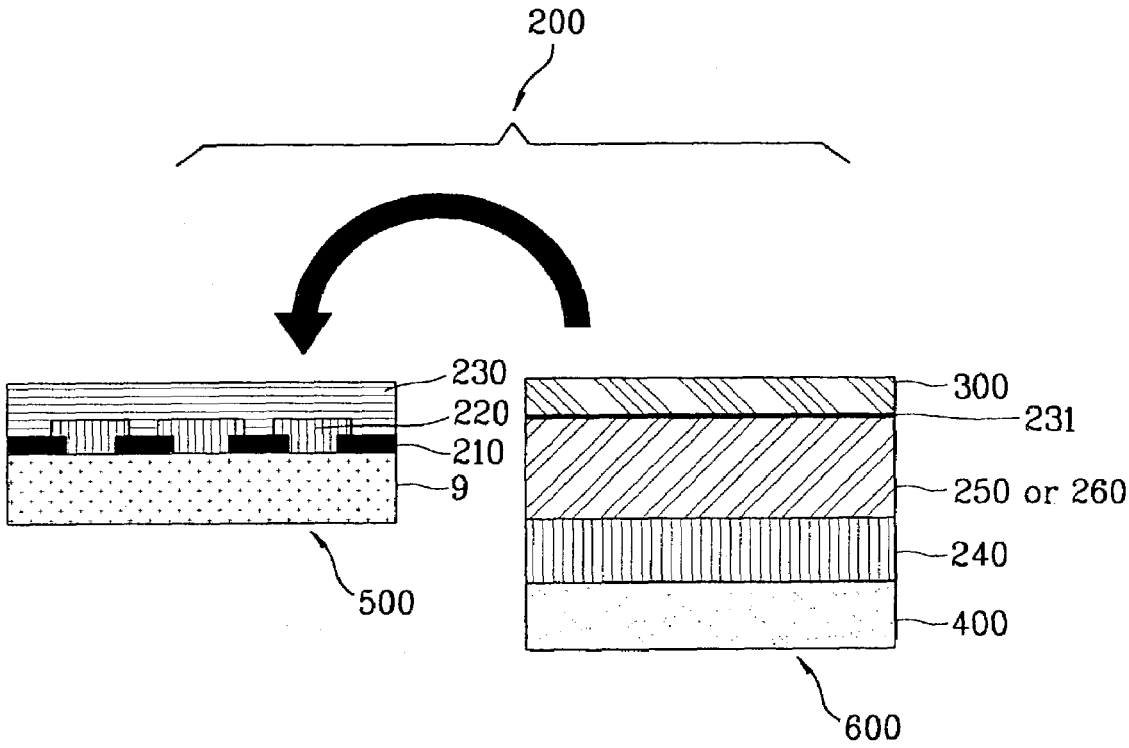
FIG. 6 is a cross-sectional view showing a fabrication method for the color flat display element according to the present invention.

Next, a second embodiment of the method for fabricating the screen 200 will be described. As shown in FIG. 6, a first sub-screen 500 is formed by laminating the fluorescent layer 220 and the resin film layer 230 on the graphite layer 210 which in turn is laminated on the face plate 9 made of glass material.

After that, a hetero-resin layer 231 is formed on a PET (polyethylene terephthalate) film 300, that is, a transcriptions film, and the iron 250 or the nickel 260 is formed thereon by the evaporating method or sputtering method. Then, the aluminum layer 240 is formed on the iron 250 or the nickel 260 by the evaporating method or the sputtering method, and then, an adhesive 400 is applied to the aluminum layer 240 to a thickness of 0.5~5.0 $\mu$m to form a second sub-screen 600.

Then, the first sub-screen 500 and the second sub-screen 600 are attached to each other using the adhesive 400 which was applied in advance.

Finally, the PET film 300 formed on the second sub-screen 600 is removed.

Figure 7:
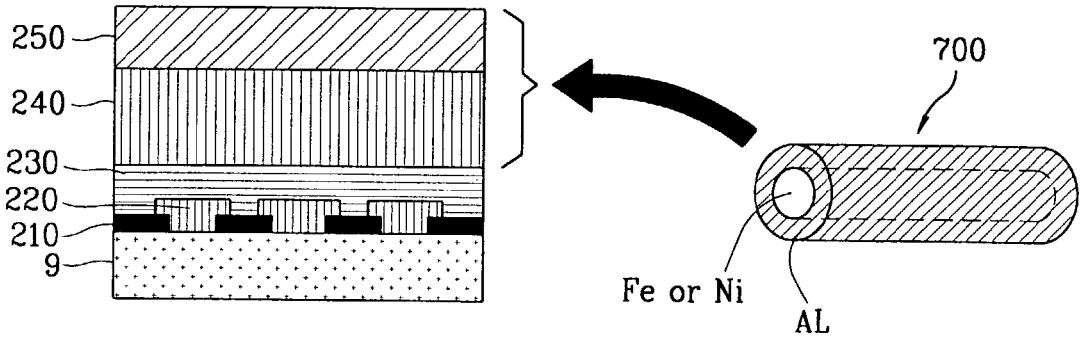
FIG. 7 is a cross-sectional view showing another embodiment of the fabrication method for the color flat display element according to the present invention.

As shown in FIG. 7, in a third embodiment of the method for fabricating the screen 200, the graphite layer 210 is laminated on the face plate 9 made of a glass material, the fluorescent layer 220 is laminated on the graphite layer 210, the resin film layer 230 is laminated on the fluorescent layer 220, and the aluminum layer 240 and the iron 250 or the nickel 260 which will be laminated thereon are successively formed using a pellet 700 which is clad with aluminum and iron, aluminum and nickel, or aluminum and chromium (not shown) by the evaporating method or the sputtering method.

In the screen 200, including the layer for preventing electron reentry and fabricated in above matter, the reentry of secondary electron toward the screen plate which is generated when the electron beam becomes incident to the screen 200, can be prevented by utilizing a metal layer such as iron 250, nickel 260, or chromium (not shown). Accordingly, the halation phenomenon can be prevented while utilizing a thinner aluminum layer 240 than that of the conventional art. Therefore, the amount of the aluminum layer 240 which is used can be reduced with a corresponding reduction in fabrication cost. That is, the thickness of the aluminum layer which is capable of restraining the reentry rate of the electron beam to less than 30% can be reduced when compared to that of the conventional art.

In the case where the voltage of the aluminum layer on the face plate 9 is 11 kV, the thickness of the aluminum layer is 1000 Å~2500 Å, 500 Å~2000 Å in the case of a voltage of 10.0~10.9 kV, 500 Å~1000 Å in the case of a voltage of 9.0~9.9 kV; and 300 Å~700 Å in the case of a voltage of 8.0~8.9 kV.

Figure 8:
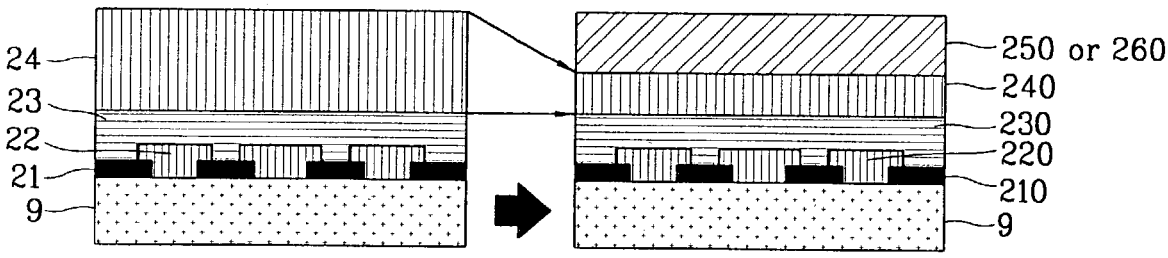
FIG. 8 is a sketch showing the extent of the thickness reduction of the aluminum layer when comparing a conventional screen with a screen applied in the color flat panel display device of the present invention.

FIG. 8 is a sketch showing a reduction in the thickness of the aluminum layer 240 comparing the screen which is utilized by the device for a color flat panel display as defined by the present invention, and the conventional screen.

According to the present invention, the halation caused by the reentry of scattered electrons on rear surface of the fluorescent layer in a display device using an electron beam can be considerably reduced and a display device of good image quality having a high degree of contrast can be obtained with an attendant reduction in fabrication costs.

As the present invention may be embodied in several forms without departing from the spirit or essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within the metes and bounds of the claims, or equivalence of such metes and bounds are therefore intended to be embraced by the appended claims.

What is claimed is:

1. A screen composite provided on a face plate of a flat panel display device, said screen composite containing an aluminum layer and a metal layer formed contiguous with said aluminum layer for substantially reducing a halation phenomenon.

2. The screen composite of claim 1, comprising:

a graphite layer provided on the face plate made of a glass material;

a fluorescent layer provided on the graphite layer;

a resin layer provided on the fluorescent layer;

the aluminum layer provided on the resin layer; and the metal layer provided on the aluminum layer.

3. The screen composite of claim 1, wherein the metal layer is at least one member selected from the group consisting of iron (Fe), nickel (Ni), and chromium (Cr).

4. The screen composite of claim 1, wherein the metal layer is formed to be immediately adjacent to the aluminum layer.

5. A screen composite provided on a face plate of a flat panel display device, said screen composite comprising a graphite layer provided on the face plate;

a fluorescent layer provided on the graphite layer;

an aluminum layer provided on the fluorescent layer; and a metal layer provided contiguous with said aluminum layer for substantially reducing a halation phenomenon caused by the reentry of scattered electrons from a rear surface of the fluorescent layer in the case of the display device using an electron beam.

* * * * *